United States Patent [19]

Boehland et al.

[11] Patent Number: 4,512,055

[45] Date of Patent: Apr. 23, 1985

[54] CHIMNEY CLEANING APPARATUS WITH MOTOR DRIVE

[75] Inventors: Burnell G. Boehland, Creswell; Donald G. Coutts, Eugene, both of Oreg.

[73] Assignee: Speedy Automatic Chimney Sweep, Inc., Eugene, Oreg.

[21] Appl. No.: 549,882

[22] Filed: Nov. 9, 1983

[51] Int. Cl.[3] ..... F23J 3/00

[52] U.S. Cl. ..... 15/249; 15/163

[58] Field of Search ..... 15/162, 163, 242, 243, 15/249, 104.2; 126/16

[56] References Cited

U.S. PATENT DOCUMENTS

| | | | |
|---|---|---|---|
| 564,988 | 8/1896 | Gerard | 15/249 |
| 946,129 | 1/1910 | Harms | 15/249 |
| 1,859,166 | 5/1932 | Premro | 15/163 |

FOREIGN PATENT DOCUMENTS

| | | | |
|---|---|---|---|
| 2327296 | 1/1975 | Fed. Rep. of Germany | 15/163 |

*Primary Examiner*—Peter Feldman

*Attorney, Agent, or Firm*—James D. Givnan, Jr.

[57] ABSTRACT

A base of the apparatus is upwardly spaced from the chimney end and supports an electric motor and reduction drive for powering a drum on which a cable is entrained. A chimney cleaning brush is mounted on a pole structure suspended from the base with vertical movement imparted to the brush by said cable. The pole structure is segmented and carries a drum at its lower end about which the cable is reversed. The pole structure is stabilized by a cross-member in abutment with the chimney walls. A motor control circuit includes switch components regulating the direction and duration of motor operation.

8 Claims, 4 Drawing Figures

CHIMNEY CLEANING APPARATUS WITH MOTOR DRIVE

BACKGROUND OF THE INVENTION

The present invention pertains to an apparatus for placement on a chimney or the like and includes a motor driven brush for cleaning of the chimney.

Chimneys or other smoke conduits such as stovepipes require periodic cleaning to dislodge creosote or other deposits adhering to chimney wall surfaces. Failure to so clean a chimney or other smoke conduit results in an accumulation of such material which ultimately may ignite resulting in a chimney fire. Presently, it is common practice to clean the interior of chimneys with a long handled brush which requires the homeowner to incur the services of chimney sweeps or, alternatively, personally accomplish the task with some degree of risk.

The known prior art discloses various chimney cleaning apparatuses which include a flexible component entrained about upper and lower pulleys for the purpose of propelling a brush structure through the chimney or other smoke conduit. For the most part such cleaning apparatuses are manually propelled and require extensive modification of the chimney. A copending patent application of the present inventors, filed Sept. 9, 1983 under Ser. No. 530,781, now U.S. Pat. No. 4,483,038, discloses a motor driven chimney brush propelled through the chimney by a powered screw shaft.

SUMMARY OF THE PRESENT INVENTION

The present invention is embodied within an apparatus for insertion into a chimney or other smoke conduit without necessitating modification thereof.

The present apparatus is intended for endwise installation into the open end of a chimney with a post member adapted for lengthwise positioning in the chimney. A base of the apparatus is disposed in upwardly spaced relationship to the chimney end and includes drive means powering a brush slidably disposed on said post. Motor controls in place on the base automatically limit the extremes of brush travel. At the post lower end is carried a drum about which a flexible element is reeved. Positioning means also at the lower end of the post stabilize the latter against lateral displacement.

Important objects include the provision of a motorized chimney cleaning apparatus adapted for use on conventional smoke conduits such as chimneys and the like without costly modification thereof; the provision of a chimney cleaning apparatus utilizing low cost components rendering the apparatus feasible for installation in the chimneys of single family dwellings; the provision of a chimney cleaning apparatus which lends itself to convenient installation and toward this end includes a post of plural segments which are assembled during installation of the apparatus; the provision of a chimney cleaning apparatus which is of low cost construction and convenient installation to enable the homeowner to install same and thereby save the cost of periodic chimney cleaning by a professional chimney sweep.

DETAILED DESCRIPTION OF THE PREFERRED EMBODIMENT

Figures 1, 2, 3, 4:
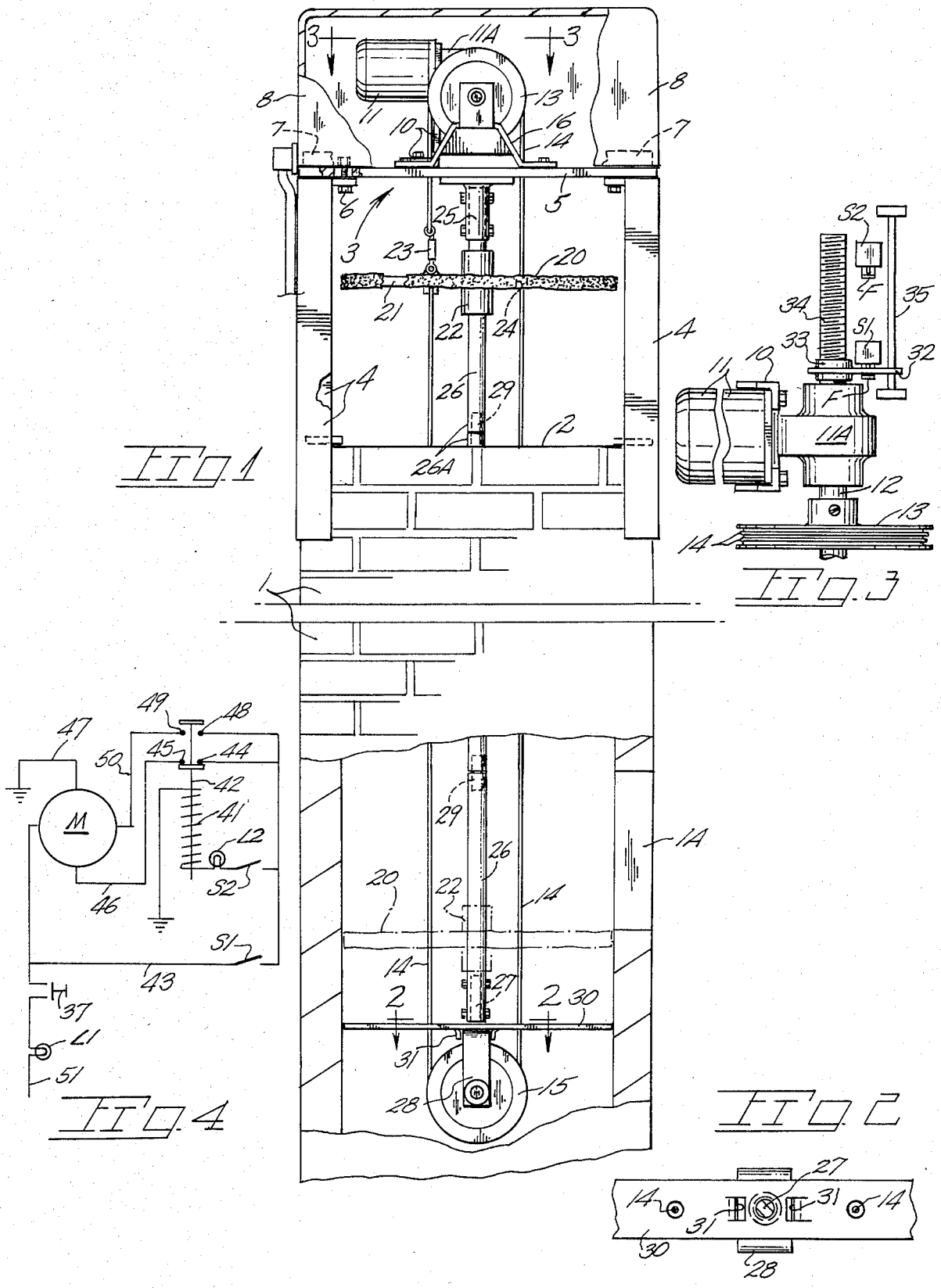
FIG. 1 is an elevational view of a chimney sectioned for purposes of illustration with the present apparatus in place thereon.
FIG. 2 is a horizontal sectional view taken downwardly along line 2—2 of FIG. 1.
FIG. 3 is a horizontal sectional view taken downwardly along line 3—3 of FIG. 1.
FIG. 4 is an electrical schematic of motor control circuitry.

With continuing attention to the drawing wherein applied reference numerals indicate parts hereinafter similarly identified, the reference numeral 1 indicates a smoke conduit, shown as a chimney, but which is understood to include other like conduits such as stovepipes through which the products of combustion enter as by an opening 1A for discharge to the atmosphere via the upper end of the chimney indicated at 2.

The present apparatus includes a base indicated generally at 3 supported in place atop a chimney by a support structure having legs at 4. A circular smoke conduit would, of course, necessitate a somewhat modified support structure. A platform 5 of the base is adjustably secured by fasteners at 6. The platform has a flange 7 extending thereabout to which a housing 8 is removably mounted in a suitable manner. The size and shape of base 3 will vary within the scope of the present invention to best suit the size and configuration of the smoke conduit.

A brush drive assembly is supported in place on platform 5 and includes a reversible motor 11 having a speed reducer 11A in place on a motor mount 10. A right angle output shaft 12 carries a pulley 13. Reeved about pulley 13 is a flexible member 14 which has a pair of downwardly extending parallel runs which pass through openings in platform 5, through openings in a later described brush structure and about a second or lower pulley 15 carried by a later described post. A bracket 16 additionally supports shaft 12.

A brush assembly includes wire bristles and a metal plate 21 having a centrally disposed attached collar 22 passing therethrough. One run of flexible element 14 is coupled to the plate by means of a turnbuckle arrangement 23 while the remaining run passes through a plate opening at 24. Flexible element 14 terminates in attachment to the plate underside.

A post structure depends from the base 3 of the apparatus and includes a socket 25 within which is suitable positioned the upper end of a post 26. Post 26 is preferably of tubular construction having engageable end segments as at 26A to enable endwise attachment of the segments to provide a post of necessary length. A threaded nipple 29 couples said end segments.

Lower pulley 15 is carried by post 26 which receives an extension 27 of a clevis 28 within which is journaled the pulley. A crossmember 30 is in abutment with the chimney interior and stabilizes the lower end of the post against lateral displacement. Said crossmember has tabs 31 thereon which abut the sides of the clevis to prevent crossmember displacement.

A motor control circuit includes first and second limit switches S1 and S2 mounted on platform 5 each having a finger at F in the path of a traveling arm 32 on a collar 33 in traveling engagement with a threaded shaft 34 having a fine pitch. Shaft 34 is driven by reversible motor 11 to advance arm 32 at low speed therealong into switch finger contact at extremes of arm travel. Movement of traveling arm 32 in each direction is concurrent with brush travel in each direction. A rod 35 stabilized traveling arm 32 against rotary forces.

With reference to the schematic, the motor control circuit includes a start switch 37 which, upon momentary closure by an operator, initiates motor operation to the extent a sustaining current flow for motor operation is established through now closed first limit switch S1. Later closure of switch S2 by arm 32 (at the limit of downward brush movement) energizes a relay 41 with its armature 42 moving to the first circuit which includes limit switch S1, line 43, contacts 44-45 and a motor lead 46. A motor ground wire is at 47. Simultaneously with breaking of the first circuit is the establishment of a second circuit including armature closed contacts 48-49 and a motor lead 50. Accordingly, at the lower limit of brush travel, switch S2 is closed to energize relay 41 to establish the second circuit to the motor whereupon speed reduced shafts 12 and 34 will now be driven in an opposite direction to return the brush component to a raised, stowed position which occurs when first limit switch S1 is opened by arm 32 returning to its start position. A light L1 is on during motor operation in one direction while light L2 indicates reverse operation of the motor. The electrical components are served by an electrical conduit 51 and ground 47.

It is to be understood that the flexible member 14 may be embodied in wire rope such as stainless steel cable or, alternatively, a chain in which instance upper and lower sprockets are substituted for pulleys 13 and 15.

If desired, sleeve 22 may include friction reducing elements in rolling contact with post 26.

While we have shown but one embodiment of the invention it will be apparent to those skilled in the art that the invention may be embodied still otherwise without departing from the spirit and scope of the invention.

Having thus described the invention, what is desired to be secured under a Letters Patent is:

We claim:

1. An apparatus for cleaning the interior of chimneys and the like, said apparatus comprising, a base for supported placement on a chimney, a post structure carried by said base and adapted for extending downwardly therefrom for lengthwise placement within the chimney, a brush assembly slidably disposed on said post for travel therealong, a brush drive assembly including a flexible member connected to the brush assembly, a first rotatable member on said base, reversible motor means coupled to said first rotatable member to drive same, a second rotatable member carried by said post structure, said flexible member entrained about said first and second rotatable members, motor operation imparting rectilinear movement of said brush assembly along said post to clean the chimney interior, and a motor control circuit in circuit with a power source to energize said motor for predetermined periods of operation in each direction of operation whereby said brush assembly will traverse the chimney in opposite directions to clean same.

2. The apparatus claimed in claim 1 wherein said post is of segmented construction.

3. The apparatus claimed in claim 2 wherein said post structure is detachably mounted to said base.

4. The apparatus claimed in claim 1 additionally including a positioning means carried by said post to maintain the latter stationary within the chimney.

5. The apparatus claimed in claim 1 wherein said reversible motor means includes speed reducing means, an arm driven by said speed reducing means for travel in a rectilinear manner, said motor control circuit including first and second limit switches contactible by said arm to alternately establish and interrupt circuits to said reversible motor means.

6. The apparatus claimed in claim 1 wherein said brush assembly includes a plate having means disposed about said post structure for travel therealong.

7. The apparatus claimed in claim 6 wherein said flexible member is adjustably coupled to the brush assembly to permit tensioning of the flexible member during installation of the apparatus.

8. The apparatus claimed in claim 1 wherein said base includes a platform and leg members for engagement with the upper end of a chimney.

* * * * *